US005947461A

United States Patent [19]

Holbrock

[11] Patent Number: 5,947,461

[45] Date of Patent: Sep. 7, 1999

[54] APPARATUS AND METHOD FOR COLLATING DOCUMENTS CUT FROM A CONTINUOUS WEB

[75] Inventor: Russell W Holbrock, Southbury, Conn.

[73] Assignee: Pitney Bowes Inc., Stamford, Conn.

[21] Appl. No.: 08/917,161

[22] Filed: Aug. 25, 1997

[51] Int. Cl.[6] ..... B65H 39/10

[52] U.S. Cl. ..... 270/52.09; 270/52.12

[58] Field of Search ..... 270/58.06, 52.08, 270/52.09, 52.17, 52.12; 271/3.01, 225

[56] References Cited

U.S. PATENT DOCUMENTS

| | | | |
|---|---|---|---|
| 4,034,973 | 7/1977 | Hams | 270/21 |
| 4,456,127 | 6/1984 | Hams | 270/52.09 |
| 4,502,676 | 3/1985 | Stocker | 270/52.09 |
| 4,674,375 | 6/1987 | Golicz | 83/91 |
| 4,785,165 | 11/1988 | Kruk | 235/375 |
| 4,795,143 | 1/1989 | Tsai | 270/52.09 |
| 4,939,888 | 7/1990 | Katz et al. | 270/52.09 |
| 4,944,503 | 7/1990 | Arima | 270/52.09 |
| 5,083,769 | 1/1992 | Young, Jr. | 271/280 |
| 5,104,104 | 4/1992 | Mol | 270/52.5 |
| 5,649,698 | 7/1997 | Auerbach et al. | 271/225 |

*Primary Examiner*—Boris Milef
*Assistant Examiner*—Patrick Mackey
*Attorney, Agent, or Firm*—Christopher J. Capelli; Melvin J. Scolnick; Robert Meyer

[57] ABSTRACT

The present invention relates to an input system for feeding one-up sheets from a paper web to a high speed mass mailing inserter system. The input system includes a feeding module for supplying a paper web having two web portions in side-by-side relationship. A merging module is located downstream in the path of travel from the feeding module and is operational to feed the two web portions in an upper-lower relationship so as to reorient the paper web from the side-by-side relationship to an upper-lower relationship. A separating module is located downstream in the path of travel from the merging module and is operational to receive the paper web in the upper-lower relationship and separate the paper web into individual two-up sheets. In order to separate the two-up sheets into one-up sheets, a stacking module is located downstream in the path of travel from the separating module and is configured to receive the two-up sheets, stack the two-up sheets and individually feed one-up sheets from the stack.

22 Claims, 3 Drawing Sheets

APPARATUS AND METHOD FOR COLLATING DOCUMENTS CUT FROM A CONTINUOUS WEB

FIELD OF THE INVENTION

The present invention relates generally to multi-station document inserting systems, which assemble batches of documents for insertion into envelopes. More particularly, the present invention is directed towards the input system for providing documents at a high speed to such multi-station document inserting systems.

BACKGROUND OF THE INVENTION

Multi-station document inserting systems generally include a plurality of various stations that are configured for specific applications. Typically, such inserting systems, also known as console inserting machines, are manufactured to perform operations customized for a particular customer. Such machines are known in the art and are generally used by organizations, which produce a large volume of mailings where the content of each mail piece may vary.

For instance, inserter systems are used by organizations such as banks, insurance companies and utility companies for producing a large volume of specific mailings where the contents of each mail item are directed to a particular addressee. Additionally, other organizations, such as direct mailers, use inserts for producing a large volume of generic mailings where the contents of each mail item are substantially identical for each addressee. Examples of such inserter systems are the 8 series and 9 series inserter systems available from Pitney Bowes, Inc. of Stamford, Conn.

In many respects the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mailpiece is produced. The exact configuration of each inserter system depends upon the needs of each particular customer or installation.

For example, a typical inserter system includes a plurality of serially arranged stations including an envelope feeder, a plurality of insert feeder stations and a burster-folder station. There is a computer generated form or web feeder that feeds continuous form control documents having control coded marks printed thereon to a cutter or burster station for individually separating documents from the web. A control scanner is typically located in the cutting or bursting station for sensing the control marks on the control documents. According to the control marks, these individual documents are accumulated in an accumulating station and then folded in a folding station. Thereafter, the serially arranged insert feeder stations sequentially feed the necessary documents onto a transport deck at each insert station as the control document arrives at the respective station to form a precisely collated stack of documents which is transported to the envelope feeder-insert station where the stack is inserted into the envelope. A typical modern inserter system also includes a control system to synchronize the operation of the overall inserter system to ensure that the collations are properly assembled.

In order for such multi-station inserter systems to process a large number of mailpieces (e.g., 18,000 mailpieces an hour) with each mailpiece having a high page count collation (at least five (5) pages), it is imperative that the input system of the multi-station inserter system is capable of cycling input documents at extremely high rates (e.g. 72,000 per hour). However, currently there are no commercially available document inserter systems having an input system with the capability to perform such high speed document input cycling. Regarding the input system, existing document inserter systems typically first cut or burst sheets from a web so as to transform the web into individual sheets. These individual sheets may be either processed in a one-up format or merged into a two-up format, typically accomplished by center-slitting the web prior to cutting or bursting into individual sheets. A gap is then generated between the sheets (travelling in either in a one-up or two-up format) to provide proper page breaks enabling collation and accumulation functions. After the sheets are accumulated, they are folded and conveyed downstream for further processing. As previously mentioned, it has been found that this type of described input system is either unable to, or encounters tremendous difficulties, when attempting to provide high page count collations at high cycling speeds.

Therefore, it is an object of the present invention to overcome the difficulties associated with input stations for console inserter systems when providing high page count collations at high cycling speeds.

SUMMARY OF THE INVENTION

The present invention provides a system and method for inputting documents in a high speed inserter system to achieve high page count collations. More particularly, the present invention provides for collecting, stacking and re-feeding individual documents after they are fed from a web supply and separated in a cutting station, preparatory to collation and accumulation of the individual documents.

In accordance with the present invention, the input system includes a feeding module for supplying a paper web having the two web portions in side-by-side relationship. A merging module is located downstream in the path of travel from the feeding module and is operational to feed the two web portions in upper-lower relationship so as to reorient the paper web from the side-by-side relationship to an upper-lower relationship. A separating module is located downstream in the path of travel from the merging module and is operational to receive the paper web in the upper-lower relationship and separate the paper web into individual two-up sheets. In order to separate the two-up sheets into one-up sheets, a stacking module is located downstream in the path of travel from the separating module and is configured to receive the two-up sheets, stack the two-up sheets in a sheet pile and individually feed one-up sheets from the stack.

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which.

DETAILED DESCRIPTION OF THE PREFERRED EMBODIMENT

Figure 1:
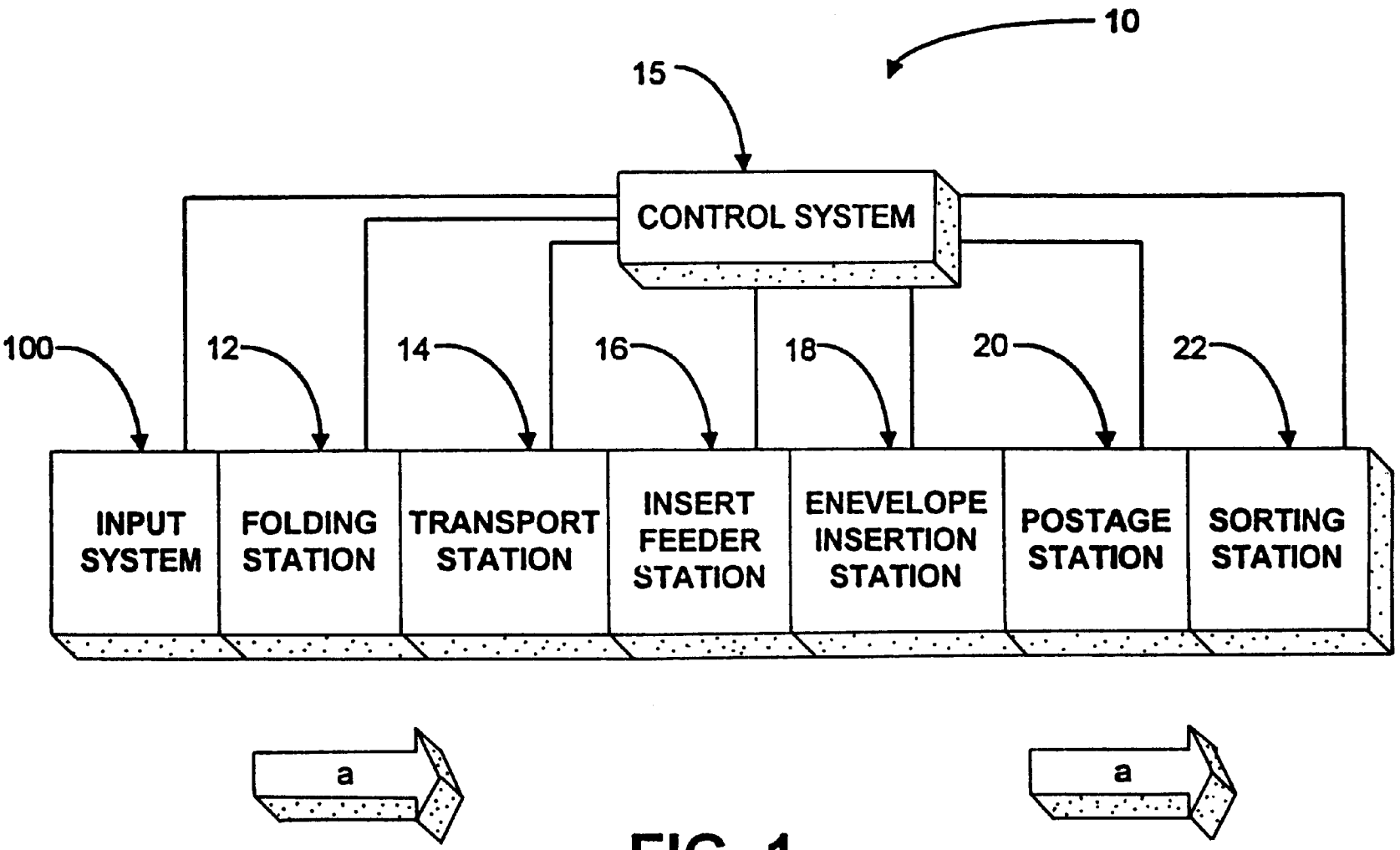
FIG. 1 is a block diagram schematic of a document inserting system in which the present invention input system is incorporated.

In describing the preferred embodiment of the present invention, reference is made to the drawings, wherein there is seen in FIG. 1 a schematic of a typical document inserting system, generally designated 10, which implements the present invention input system 100. In the following description, numerous paper handling stations implemented in inserter system 10 are set forth to provide a thorough understanding of the operating environment of the present invention. However it will become apparent to one skilled in the art that the present invention may be practiced without the specific details in regards to each of these paper-handling stations.

As will be described in greater detail below system 10 preferably includes an input system 100 that feeds paper sheets from a paper web to an accumulating station that accumulates the sheets of paper in collation packets. Preferably, only a single sheet of a collation is coded (the control document), which coded information enables the control system 15 of inserter system 10 to control the processing of documents in the various stations of the mass mailing inserter system. The code can comprise a bar code, UPC code or the like.

Essentially, input system 100 feeds sheets in a paper path, as indicated by arrow "a," along what is commonly termed the "main deck" of inserter system 10. After sheets are accumulated into collations by input system 100, the collations are folded in folding station 12 and the folded collations are then conveyed to a transport station 14, preferably operative to perform buffering operations for maintaining a proper timing scheme for the processing of documents in inserting system 10.

Each sheet collation is fed from transport station 14 to insert feeder station 16. It is to be appreciated that a typical inserter system 10 includes a plurality of feeder stations, but for clarity of illustration only a single insert feeder 16 is shown. Insert feeder station 16 is operational to convey an insert (e.g., an advertisement) from a supply tray to the main deck of inserter system 10 so as to be nested with the aforesaid sheet collation being conveyed along the main deck. The sheet collation, along with the nested insert(s) are next conveyed into an envelope insertion station 18 that is operative to insert the collation into an envelope. The envelope is then preferably conveyed to postage station 20 that applies appropriate postage thereto. Finally, the envelope is preferably conveyed to sorting station 22 that sorts the envelopes in accordance with postal discount requirements.

As previously mentioned, inserter system 10 includes a control system 15 coupled to each modular component of inserter system 10, which control system 15 controls and harmonizes operation of the various modular components implemented in inserter system 10. Preferably, control system 15 uses an Optical Character Reader (OCR) for reading the code from each coded document. Such a control system is well known in the art and since it forms no part of the present invention, it is not described in detail in order not to obscure the present invention. Similarly, since none of the other above-mentioned modular components (namely: folding station 12, transport station 14, insert feeder station 16, envelope insertion station 18, postage station 20 and sorting station 22) form no part of the present invention input system 100, further discussion of each of these stations is also not described in detail in order not to obscure the present invention. Moreover, it is to be appreciated that the depicted embodiment of inserter system 10 implementing the present invention input system 100 is only to be understood as an example configuration of such an inserter system 10. It is of course to be understood that such an inserter system may have many other configurations in accordance with a specific user's needs.

Figure 2:
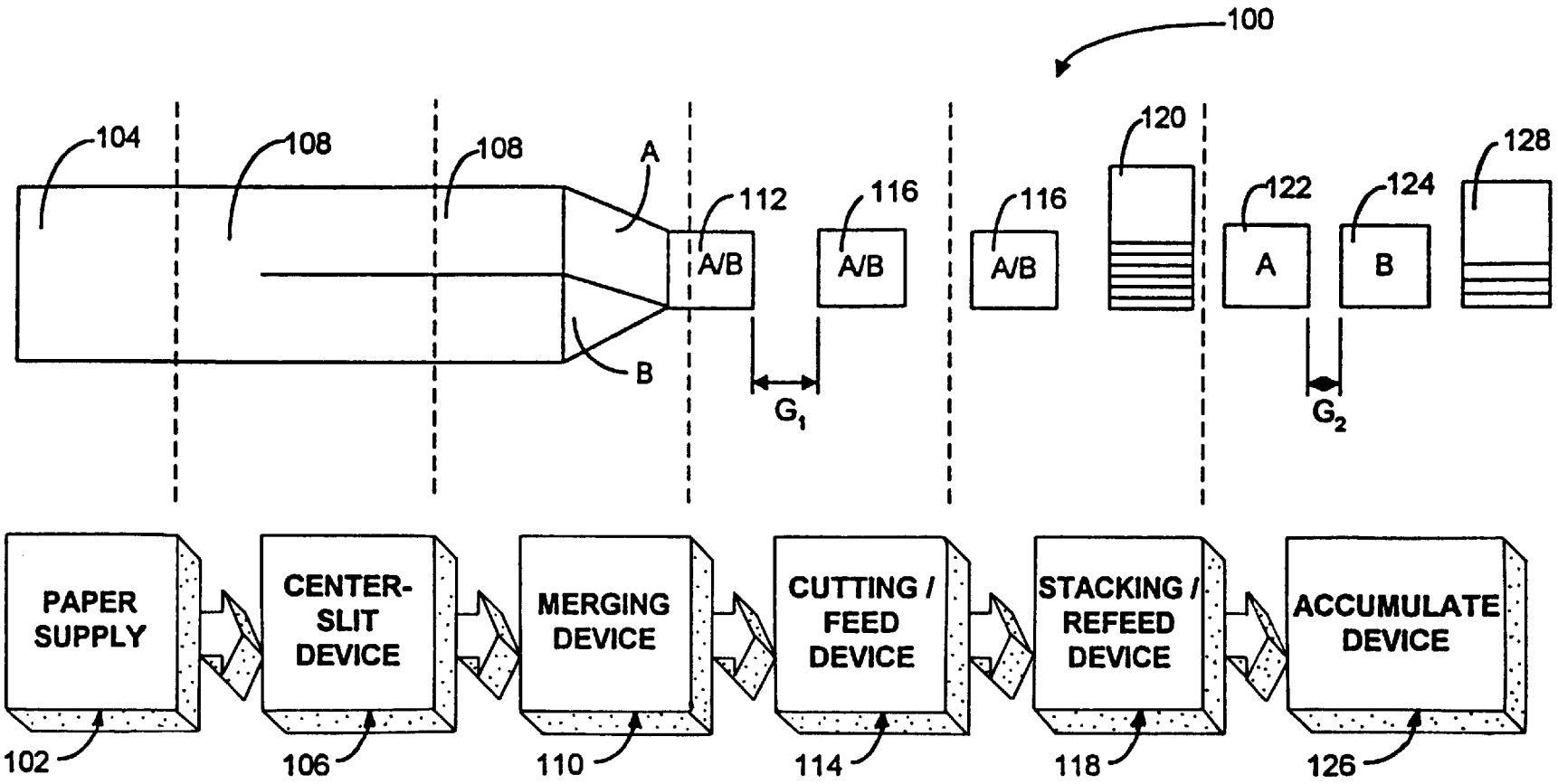
FIG. 2 is a block diagram schematic of the present invention input stations implemented in the inserter system of FIG. 1.

Referring now to FIG. 2 the present invention input system 100 is shown. In the preferred embodiment, insert system 100 consists of a paper supply 102, a center-slitting device 106, a merging device 110, a cutting and feed device 114, a stacking and re-feed device 118 and an accumulating device 126. Regarding paper supply device 102, it is to be understood to encompass any known device for supplying side-by-side sheets from a paper web 104 to input system 100 (i.e., enabling a two-up format). Paper supply device 102 may feed the side-by-side web 104 from a web roll, which is well known in the art. Alternatively, paper supply device 102 may feed the side-by-side web 104 from a fan-fold format, also well known in the art. As is typical, web 104 is preferably provided with apertures (not shown) along its side margins for enabling feeding into paper supply station 102, which apertures are subsequently trimmed and discarded.

A center-slit device 106 is coupled to paper supply station 102 and provides a center slitting blade operative to center slit the web 104 into side-by-side uncut sheets 108 (A and B). Coupled to center-slit device 106 is a merging device 110 operative to transfer the center-slit web 108 into an upper-lower relationship, commonly referred to as a "two-up" format 112. That is, merging device 110 merges the two uncut streams of sheets A and B on top of one another, wherein as shown in FIG. 2, the left stream of uncut sheets A are positioned atop the right stream of sheets B producing a "two-up" (A/B) web 112. It is to be appreciated that even though the merging device 110 of FIG. 2 depicts the left side uncut sheets A being positioned atop the right side uncut sheets B (A/B), one skilled in the art could easily adapt merging device to position the right side uncut sheets B atop the left side A uncut sheets (B/A). An example of such a merging device for transforming an uncut web from a side-by-side relationship to an upper-lower relationship can be found in commonly assigned U.S. Pat. No. 5,104,104, which is hereby incorporated by reference in its entirety.

A cutting and feed device 114 is coupled to merging device 110 and is operative to cut the "two-up" A/B web 112 into separated "two-up" (A/B) individual sheets 116. Preferably, cutting and feed device 114 includes either a rotary or guillotine type cutting blade, which cuts the two sheets A and B atop one another 116 every cutter cycle. Preferably, the "two-up" (ANB) sheets 116 are fed from cutting and feed device 114 with a predetermined gap $G_1$ between each succession of "two-up" (A/B) collations 116 conveying downstream from cutting and feed device 114. It is to be appreciated that in order to maintain a high cycle speed for inserter system 10, the aforesaid "two-up" (A/B) web 112 is continually transported into cutting and feed device 114 at a constant velocity.

A stacking and re-feed device 118 is coupled in proximity and downstream to cutting and feed device 114 and is operative to separate the "two-up" (A/B) sheet collations 116 into individual sheets 124 (A) and 126 (B). Stacking and re-feed device 118 is needed since the "two-up" (A/B) web 112 is merged before being cut into individual sheets and it is necessary to separate the two-up sheets 116 into individual sheets 122 (A) and 124 (B) prior to further downstream processing in inserter system 10. In the present preferred embodiment, the two-up sheets 116 (A and B) are separated from one another by stacking the aforesaid "two-up" (A/B) sheet collations 116 atop of one another in a stacking pile 120. Stacking and re-feed device 118 is configured to individually (e.g., in seriatim) feed one-up sheets 122, 124 (A, B) from sheet stack 120. Sheet and re-feed device 118 is further configured to individually re-feed the sheets from the bottom of stack 120 with a predetermined gap $G_2$ between each successive sheet 122 (A) and 124 (B). This gap $G_2$ may be varied by stacking and re-feed device 118 under instruction from control system 15, which gap $G_2$ provides breakpoints for enabling proper accumulation in downstream accumulating device 126.

It is pointed out that another advantage afforded by stacking and re-feed device 118 is that it enables inserter system 10 to maintain a high cycle speed. That is, in order for inserter system 10 to maintain a high cycle speed (e.g., approximately 18,000 mailpieces per hour) it is essential for the input of inserter system 100 to have a considerably greater cycle speed (e.g., approximately 72,000 sheets per hour) due to resulting time requirements needed for subsequent downstream processing (e.g., collating, accumulating, folding, etc). Furthermore, stacking and re-feed device 118 enables sheets to be fed in the aforesaid two-up format 116 from a web roll at an approximately constant speed (e.g., 36,000 cuts per hour) which is also advantageous in that it is difficult to control to the rotational speed of a large web roll (especially at high speeds) for feeding sheets therefrom due to the large inertia forces present upon the web roll. The individual sheets 122, 124 (A, B) are then individually fed from stack 120 at a second speed (e.g., over 250 inches per second), which second speed is greater than the input speed (e.g., approximately 117 inches per second).

Coupled downstream to the stacking and re-feed device 118 is an accumulating device 126 for assembling a plurality of individual sheets of paper into a particular desired collation packet prior to further downstream processing. In particular, accumulating device 126 is configured to receive the seriatim fed individual sheets 122 and 124 from stacking and re-feed device 118, and pursuant to instructions by control system 15, collates a predetermined number of sheets 128 before advancing that collation downstream in inserter system 10 for further processing (e.g., folding). Accumulator device 126 may collate the sheets into the desired packets either in the same or reverse order the sheets are fed thereinto. Each collation packet 128 may then be folded, stitched or subsequently combined with other output from document feedings devices located downstream thereof and ultimately inserted into a envelope. It is to be appreciated that such accumulating devices are well known in the art, an example of which is commonly assigned U.S. Pat. No. 5,083,769 hereby incorporated by reference in its entirety.

Therefore, an advantage of the present invention mass mailing input system 100 is that it: 1) center slits a web before cutting the web 108 into individual sheets 116; 2) feeds individual sheets 116 at a high speed in a two-up format to a stacking pile 120; and 3) feeds individual sheets 122,124 (A, B) in seriatim in a one-up format from the stacking pile 120 for subsequent processing in the high speed inserter system 10. As mentioned above, this system arrangement is particularly advantageous in high-speed inserter systems where it is imperative to provide input sheets at high cycle speeds. In particular, the present invention input system 100 is advantageous in that it eliminates the need for a merging device downstream of the cutting device that results in an additional operation and time. Furthermore, the stacking of individual sheets in stacking and re-feed device 118 acts as a buffer between the accumulating device 126 and the paper supply 102 and provides quick response times to a feed and gap request from the control system 15 while enabling the paper supply 102 to provide a constant feed of documents.

Figure 3:
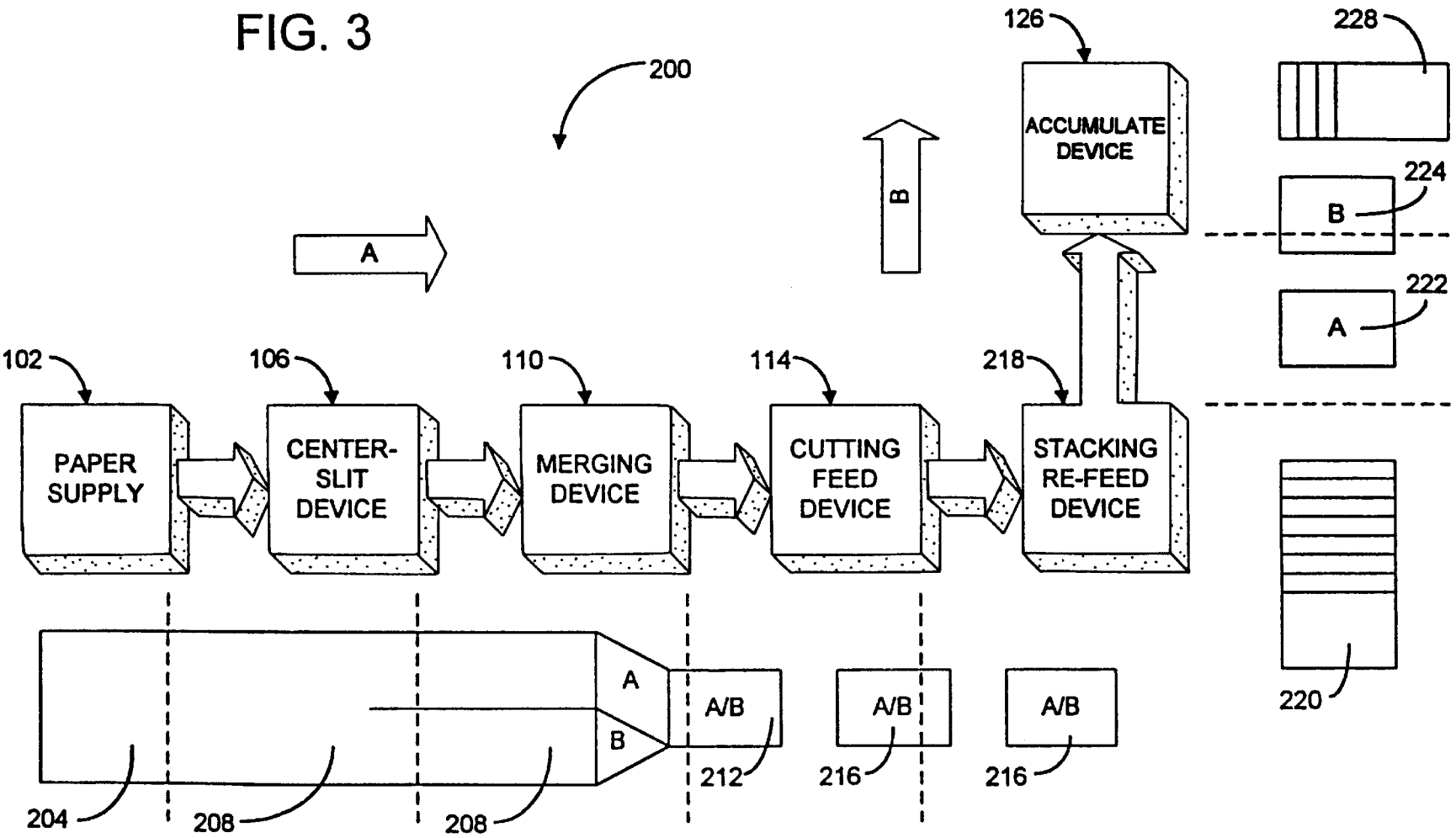
FIG. 3 is a block diagram schematic of another embodiment of the present invention input system.

Referring now to FIG. 3, there is shown an input system designated generally by reference numeral 200 that is substantial similar to the above described input system 100, wherein like reference numerals identify like objects. The difference being that stacking and re-feed device 218 of input system 200 is also configured as a "right-angle-turner." That is, stacking and re-feed device 218 changes the direction of travel for sheets 216 feeding from cutting device 114 by 90° relative to sheets 222 feeding from stacking and re-feed device 218.

In operation, and as depicted in FIG. 3, two-up sheets 216 are fed from cutting device 114 into stacking device 218 along a first direction of travel (represented by arrow "A"). As previously mentioned with regard to the stacking device 118 of input system 100, stacking device 218 stacks atop one another the two-up sheets 216 in a sheet pile 220. However, unlike the stacking device 118 of input system 100, stacking device 218 individually feeds, in seriatim, one-up sheets 222 and 224 along a second direction of travel (represented by arrow "B") oriented 90° relative to the aforesaid first direction of travel (represented by arrow "A").

An advantage of this arrangement is that sheets 216 can be fed from a paper supply 102 in a landscape orientation, whereby stacking device 218 changes the sheet orientation to a portrait orientation when sheets 222 are fed downstream from stacking device 218. Of course it is to be appreciated that the input system depicted in FIG. 3 is not to be understood to be limited to changing a sheets orientation of travel from landscape to portrait, as input system 200 may be adapted by one skilled in the art to change a sheets orientation of travel from portrait to landscape. An additionally advantage of input system 200 is that it changes the overall footprint of an inserter system, which is often required so as to suit a customers designated area that is to accommodate the inserter system.

In summary, an input system 100 for providing individual documents to a high speed mass mailing inserter system 10 has been described. Although the present invention has been described with emphasis on a particular embodiment, it should be understood that the figures are for illustration of the exemplary embodiment of the invention and should not be taken as limitations or thought to be the only means of carrying out the invention. Further, it is contemplated that many changes and modifications may be made to the invention without departing from the scope and spirit of the invention as disclosed.

What is claimed is:

1. An input system for supplying individually one-up sheets to an inserter system from a paper web having two portions of travel, the input system comprising:

a feeding module for supplying the paper web having the two web portions in a side-by-side relationship;

a merging module located downstream in the path of travel from the feeding module for feeding the two web portions in upper-lower relationship so as to reorient the paper web from side-by-side to upper-lower relationship;

a separating module located downstream in the path of travel from the merging module for receiving the paper web in the upper-lower relationship and separating the paper web into individual sheets in an upper-lower relationship; and a stacking module located downstream in the path of travel from the separating module, the stacking module having an upstream side and downstream side and is configured to receive from the upstream side the individual separated sheets in an upper-lower relationship, stack the individual sheets and individually feed one-up sheets from the stack through the downstream side.

2. An input system as recited in claim 1 further including:

an accumulating module located downstream in the path of travel from the stacking module for collecting a predetermined number of individual one-up sheets in a sheet collation.

3. An input system as recited in claim 1, wherein the merging module includes a center mounted slitting blade for separating the paper web having two portions in the side-by-side relationship.

4. An input system as recited in claim 1, wherein the separating module includes a cutting blade for cutting the web into individual sheets.

5. An input system as recited in claim 1, wherein the separating module is coupled to a control system operative to instruct the separating module to provide a predetermined spaced gap between each succession of individual sheets in the upper-lower relationship that are being conveyed downstream from the separating module.

6. An input system as recited in claim 5, wherein the stacking module is coupled to the control system, which control system is operative to instruct the stacking module to provide a predetermined gap between each individual one up sheet being conveyed downstream from the stacking module.

7. An input system as recited in claim 1, wherein the stacking module is operative to receive in the upstream side, in a first velocity, the individual sheets in an upper-lower relationship and convey from the downstream side with a second velocity the individual one-up sheets, wherein the second velocity is greater than the first velocity.

8. An input system as recited in claim 1 wherein the stacking module is configured to receive sheets in the upstream side from a first direction of travel and convey sheets from the downstream side in a second direction of travel wherein the second direction of travel is oriented 90° relative to the second direction of travel.

9. A mass mailing inserter system having an input system for supplying individual one-up sheets from a paper web having two portions of travel, the inserter system comprising:

a feeding module for supplying the paper web having the two web portions in side-by-side relationship;

a merging module located downstream in the path of travel from the feeding module for feeding the two web portions in upper-lower relationship so as to reorient the paper web from side-by-side to upper-lower relationship;

a separating module located downstream in the path of travel from the merging module for receiving the paper web in the upper-lower relationship and separating the paper web into individual sheets in an upper-lower relationship;

a stacking module located downstream in the path of travel from the separating module, the stacking module having an upstream side and downstream side and is configured to receive from the upstream side the individual separated sheets in an upper-lower relationship, stack the individual sheets and individually feed one-up sheets from the stack through the downstream side;

an accumulating module located downstream in the path of travel from the stacking module for collecting a predetermined number of individual one-up sheets in a sheet collation;

a folding module located downstream in the path of travel from the accumulating module for folding the sheet collation; and an insertion module located downstream in the path of travel from the folding station for inserting the folded sheet collation into an envelope.

10. An inserter system as recited in claim 9, further including:

at least one insert feeder module located downstream in the path of travel from the folding station and upstream in the path of travel from the insertion module, the insert feeder module being operative to insert an enclosure into a sheet collation.

11. An inserter system as recited in claim 9 wherein the merging module includes a center mounted slitting blade for separating the paper web having two portions in a side-by-side relationship.

12. An inserter system as recited in claim 9, wherein the separating module includes a cutting blade for cutting the web into individual sheets.

13. An inserter system as recited in claim 9, wherein the separating module is coupled to a control system operative to instruct the separating module to provide a predetermined spaced gap between each succession of individual sheets in an upper-lower relationship that are being conveyed downstream from the separating module.

14. An inserter system as recited in claim 13, wherein the stacking module is coupled to the control system, which control system is operative to instruct the stacking module to provide a predetermined spaced gap between each individual one up sheet being conveyed downstream from the stacking module.

15. An inserter system as recited in claim 9, wherein the stacking module is operative to receive in the upstream side, in a first velocity, the individual sheets in an upper-lower relationship and convey from the downstream side with a second velocity the individual one-up sheets, wherein the second velocity is greater than the first velocity.

16. An inserter system as recited in claim 9 wherein the stacking module is configured to receive sheets in the upstream side from a first direction of travel and convey sheets from the downstream side in a second direction of travel wherein the second direction of travel is oriented 90° relative to the second direction of travel.

17. A method for supplying individual one-up sheets to an inserter system from a web having two portions of travel comprising the steps of:

supplying a paper web having two portions in side-by-side relationship;

merging the two portions of the web from the side-by-side relationship to an upper-lower relationship;

separating the upper-lower relationship paper web into individual two-up sheets;

stacking the individual two-up separated sheets in a stacking pile; and feeding from the stacking pile individual one-up sheets.

18. A method as recited in claim 17 further comprising the step:

accumulating a predetermined number of one-up sheets in a sheet collation.

19. A method as recited in claim 17, wherein the merging step includes the step of center-slitting the paper web having the two web portions in side-by-side relationship.

20. A method as recited in claim 17, wherein the separating step includes the step of cutting the upper-lower relationship into individual two-up sheets.

21. A method as recited in claim 17 further including the steps of:

providing a first controlled gaped space between each succession of individual two-up sheets; and providing a second controlled gaped space between each individual one-up sheet.

22. A method as recited in claim 17 wherein the stacking step includes the step of receiving individual two-up sheets in a first direction of travel; and the feeding step feeds individual one-up sheets in a second direction of travel oriented substantially at 90° relative to the first direction of travel.

* * * * *